US011760090B2

(12) United States Patent
Takahashi et al.

(10) Patent No.: US 11,760,090 B2
(45) Date of Patent: Sep. 19, 2023

(54) LIQUID EJECTION HEAD CIRCUIT BOARD AND LIQUID EJECTION HEAD

(71) Applicant: CANON KABUSHIKI KAISHA, Tokyo (JP)

(72) Inventors: Kenji Takahashi, Kanagawa (JP); Mai Hirohara, Kanagawa (JP); Seiko Minami, Saitama (JP)

(73) Assignee: Canon Kabushiki Kaisha, Tokyo (JP)

( * ) Notice: Subject to any disclaimer, the term of this patent is extended or adjusted under 35 U.S.C. 154(b) by 119 days.

(21) Appl. No.: 17/523,590

(22) Filed: Nov. 10, 2021

(65) Prior Publication Data

US 2022/0153027 A1 May 19, 2022

(30) Foreign Application Priority Data

Nov. 13, 2020 (JP) ..... 2020-189846

(51) Int. Cl.
*B41J 2/14* (2006.01)

(52) U.S. Cl.
CPC ..... *B41J 2/14129* (2013.01); *B41J 2/14032* (2013.01); *B41J 2/14072* (2013.01); *B41J 2202/03* (2013.01)

(58) Field of Classification Search
CPC ..... B41J 2/14129; B41J 2/14032; B41J 2/14072; B41J 2202/03
See application file for complete search history.

(56) References Cited

U.S. PATENT DOCUMENTS 10,906,305 B2 * 2/2021 Teshima ..... H01L 27/00
11,001,062 B2 * 5/2021 Teranishi ..... B41J 2/1631

FOREIGN PATENT DOCUMENTS

JP 2016137705 A 8/2016

* cited by examiner

*Primary Examiner* — Geoffrey S Mruk
(74) *Attorney, Agent, or Firm* — Canon U.S.A., Inc., IP Division

(57) ABSTRACT

A liquid ejection head circuit board including a substrate, a heat generating resistance element that generates heat energy used for ejection of liquid, an electric wiring layer that is electrically connected to the heat generating resistance element, and an insulating film that insulates the electric wiring layer. The insulating film includes a first insulating film and a second insulating film on the first insulating film, the first insulating film is a first SiOCN film, and the second insulating film is a second SiOCN film containing more carbon than the first SiOCN film or a low-density insulating film with a lower density than the first SiOCN film.

12 Claims, 5 Drawing Sheets

LIQUID EJECTION HEAD CIRCUIT BOARD AND LIQUID EJECTION HEAD

BACKGROUND OF THE INVENTION

Field of the Invention

The present disclosure relates to a liquid ejection head circuit board and a liquid ejection head.

Description of the Related Art

As one of recording methods using an inkjet head that is a typical liquid ejection head, there is a method in which a heat generating element heats ink to cause bubbling and the ink is ejected by using these air bubbles.

Japanese Patent Application Laid-Open No. 2016-137705 describes a technique in which, in an inkjet head, an insulating body such as SiO is used as an interlayer insulating film that electrically insulates multiple electrical wiring layers from one another and the electrical wiring layer and a heat generating element from each other.

When the inkjet head that employs SiO as the interlayer insulating film and that is disclosed in Japanese Patent Application Laid-Open No. 2016-137705 is used for a long period with the ink entering the interior of the liquid ejection head circuit board due to an incidental damage or the like, the ink sometimes causes the interlayer insulating film to dissolve. When the ink reaches an electric wiring layer common to multiple elements due to the dissolution of the interlayer insulating film, adjacent elements electrically connected to one another cannot eject the ink. The reliability of the inkjet head decreases by the dissolution of the interlayer insulating film as described above and suppression of the decrease in reliability is thus a challenge.

SUMMARY OF THE INVENTION

In view of the aforementioned background, an aspect of the present disclosure is to provide a liquid ejection head circuit board in which a decrease in reliability is suppressed and that has a longer life and a liquid ejection head that includes the liquid ejection head circuit board.

According to one aspect of the present disclosure, there is provided a liquid ejection head circuit board including a substrate, a heat generating resistance element that generates heat energy used for ejection of liquid, an electric wiring layer that is electrically connected to the heat generating resistance element, and an insulating film that insulates the electric wiring layer. The insulating film includes a first insulating film and a second insulating film on the first insulating film, the first insulating film is a first SiOCN film, and the second insulating film is a second SiOCN film containing more carbon than the first SiOCN film or a low-density insulating film with a lower density than the first SiOCN film.

According to another embodiment of the present disclosure, a liquid ejection head including the aforementioned liquid ejection head circuit board is provided.

The present disclosure can provide a liquid ejection head circuit board in which a decrease in reliability is suppressed and that has a longer life and a liquid ejection head that includes the liquid ejection head circuit board.

Further features of the present disclosure will become apparent from the following description of exemplary embodiments with reference to the attached drawings.

DESCRIPTION OF THE EMBODIMENTS

Figure 1A:
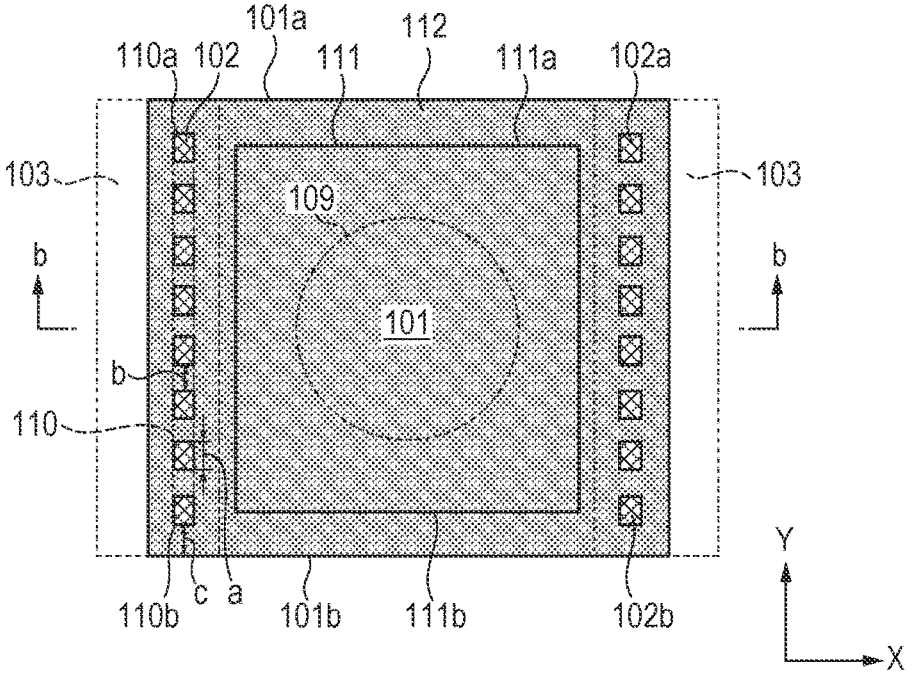
FIGS. 1A and 1B are a plan view and a cross-sectional view of a portion around a heat generating resistance element in a liquid ejection head according to an embodiment of the present disclosure.

A liquid ejection head can be mounted on information output apparatuses such as a printer, a photocopier, a facsimile having a communication system, and a word processor having a printer unit as well as industrial recording apparatuses in which various types of processing apparatuses are complexly combined. Moreover, recording can be performed on various types of record media such as paper, yarn, fiber, fabric cloth, metal, plastic, glass, wood, and ceramics by using the liquid ejection head.

The "recording" used in this description means not only providing images that have meanings such as characters and figures but also providing images that have no meanings such as patterns on the record media.

Moreover, the "liquid" used in this description is to be widely interpreted and is assumed to include not only an ink used in a recording operation but also the following liquids. Specifically, the "liquid" also includes liquids used for formation of an image, a design, a pattern, and the like, for processing of the record media, and for treatment of the ink or the record media. The treatment of the ink or the record media herein refers to, for example, treatment for improving fixability of a color material in the ink applied to the record media by causing the color material to solidify or become insoluble, treatment of improving recording quality or coloring property, or treatment for improving image durability. Moreover, the "liquid" used in the liquid ejection head of the present disclosure generally include a large amount of electrolyte and is electrically conductive.

A liquid ejection head circuit board and a liquid ejection head in an embodiment of the present disclosure are described below with reference to the drawings. Note that, in the following description, configurations having the same function are denoted by the same number in the drawings.

Figure 1B:
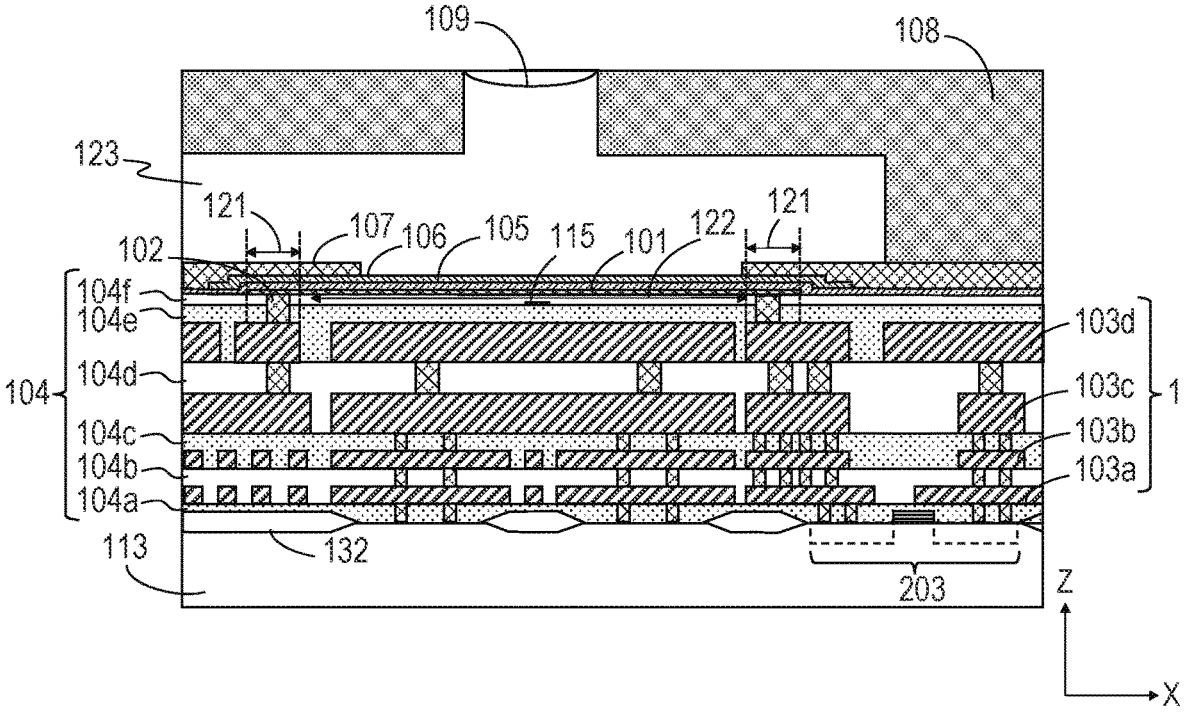

As illustrated in FIG. 1B, an element circuit board 100 (FIG. 4) of the liquid ejection head circuit board includes a circuit board 114 and an ejection port formation member 108.

The circuit board 114 includes a substrate 113 made of Si and an interlayer insulating film 104 formed on the substrate 113. A heat generating resistance element 101 that generates heat energy used for ejection of the liquid, a protection film 105, and an anti-cavitation film 106 are provided on the circuit board 114. The circuit board 114 may be provided with a temperature detection element 115 located below the heat generating resistance element 101 with an interlayer insulation film arranged between the temperature detection element 115 and the heat generating resistance element 101. The temperature detection element 115 can be formed of a thin-film resistance of Al, Pt, Ti, Ta, or the like. An adhesiveness improvement film 107 is formed on the protection film 105 and the anti-cavitation film 106 not to cover the heat generating resistance element 101. The adhesiveness improvement film 107 can improve adhesiveness between members on the upper surface side of the circuit board 114 and the ejection port formation member 108.

The interlayer insulating film 104 includes a first interlayer insulating film 104*f* located between the heat generating resistance element 101 and the temperature detection element 115 and a second interlayer insulating film 104*e* located between the temperature detection element 115 and a first electric wiring layer 103*d* that is a ground wiring layer. Moreover, the interlayer insulating film 104 includes a third interlayer insulating film 104*d* located between the first electric wiring layer 103*d* and a second electric wiring layer 103*c* that is a power supply wiring layer. Furthermore, the interlayer insulating film 104 includes a fourth interlayer insulating film 104*c* located between the second electric wiring layer 103*c* and a third electric wiring layer 103*b* that is a logic power supply wiring layer. Moreover, the interlayer insulating film 104 includes a fifth interlayer insulating film 104*b* located between the third electric wiring layer 103*b* and a fourth electric wiring layer 103*a* that is a signal wiring layer. Furthermore, the interlayer insulating film 104 includes a sixth interlayer insulating film 104*a* located below the fourth electric wiring layer 103*a*.

At least one of the first interlayer insulating film 104*f*, the second interlayer insulating film 104*e*, and the third interlayer insulating film 104*d* includes a SiOCN film (silicon oxycarbonitride film) made of an insulating body containing a material expressed by SiOCN. The first interlayer insulating film 104*f*, the second interlayer insulating film 104*e*, and the third interlayer insulating film 104*d* may partially include an insulating film such as a SiO film (silicon oxide film) formed by high-density plasma chemical vapor deposition (CVD) in addition to the SiOCN film to improve throwing power to the wiring layers. Forming these interlayer insulating films partially or entirely of the SiOCN film can improve resistance against dissolution into ink. Moreover, when a configuration in which the SiO film is formed on the SiOCN film in the interlayer insulating films is employed, only the SiO film needs to be planarized and the case where processes become complicated can be avoided.

Figure 2:
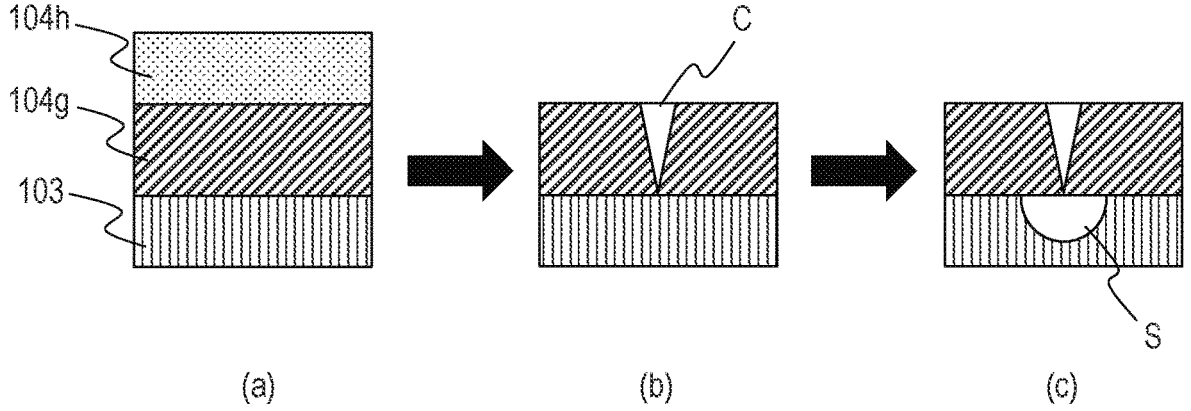
FIG. 2 is a schematic cross-sectional view for explaining a laminated structure of an electric wiring layer and an interlayer insulating film according to background art and ink erosion.

When the configuration in which the SiO film is formed on the SiOCN film is employed in the aforementioned structure, the following disadvantage occurs in some cases. When the ink enters an interior of the liquid ejection head circuit board due to an incidental damage or the like, the SiO film that can easily dissolve into the ink dissolves and the SiOCN film that is difficult to dissolve into the ink is left. When the liquid ejection head circuit board deforms due to external force in a state where the SiOCN film is exposed on the outermost layer as described above, a crack may be formed in the SiOCN film depending on conditions. When there is only one layer of SiOCN film, since there is no deterrent against development of crack, the crack develops to a deep portion of the film once the crack is formed. As a result, there may occur a case where, although the SiOCN film itself is present without dissolving, the ink enters the interior of the liquid ejection head circuit board through a crack portion and causes the electric wiring layer to dissolve. Such a state is illustrated in FIG. 2. (a) of FIG. 2 illustrates a laminate configuration before dissolution of a SiO film 104*h* due to ink erosion. (b) of FIG. 2 illustrates a state where the SiO film 104*h* has dissolved due to the ink erosion and a crack C is formed in a SiOCN film 104*g* and has developed to a deep portion of the film. (c) of FIG. 2 illustrates a state where the ink enters the interior through the crack portion and causes an electric wiring layer (AL wiring) 103 to dissolve and a dissolved portion S is formed.

The following first configuration or second configuration in which an insulating film for insulating an electric wiring layer includes a first insulating film and a second insulating film provided on the first insulating film is effective in preventing dissolution of the electric wiring layer due to the aforementioned phenomenon.

At least one of the insulating film on the ground wiring layer and the insulating film on the power supply wiring layer is preferably the insulating film including the first and second insulating films.

Figure 3:
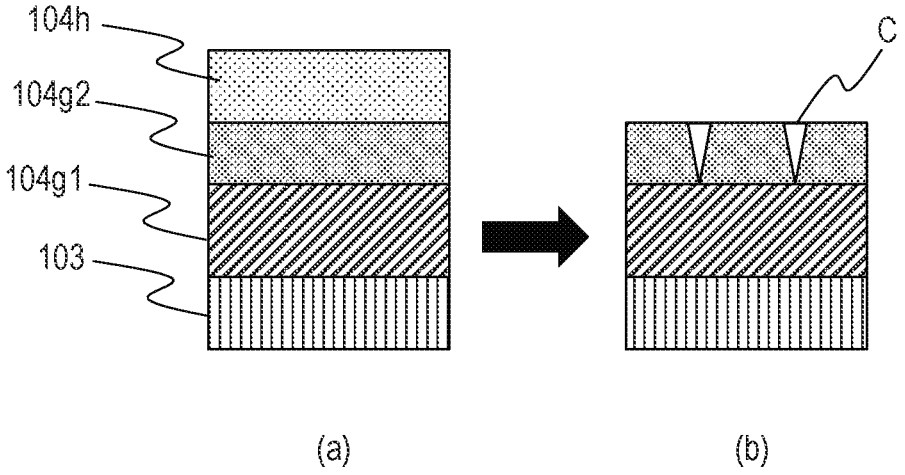
FIG. 3 is a schematic cross-sectional view for explaining laminated structure of an electric wiring layer and an interlayer insulating film according to the embodiment of the present disclosure and an effect of preventing the ink erosion.

The first configuration is a configuration in which the first insulating film is a first SiOCN film and the second insulating film is a second SiOCN film containing more carbon than the first SiOCN film. Specifically, a configuration in which the second SiOCN film containing more carbon than the first SiOCN film is formed on the first SiOCN film is effective. Since a SiOCN film containing more carbon is harder and a crack is more likely to be formed therein, formation of a crack due to deformation caused by external force concentrates in the second SiOCN film. Since stress is released by formation of a crack in the second SiOCN film and a crack is less likely to be formed in the first SiOCN film, a crack is hardly formed in the first SiOCN film. Since a crack is hardly formed in the first SiOCN film and the first SiOCN film remains present without dissolving, no ink enters the deep portion and the wiring does not dissolve. Such a state is illustrated in FIG. 3. (a) of FIG. 3 illustrates a laminate configuration before the dissolution of the SiO film 104*h* due to ink erosion. (b) of FIG. 3 illustrates a state where the SiO film 104*h* has dissolved due to ink erosion. When the circuit board deforms due to external force in this state, a crack C is formed in a second SiOCN film 104*g*2 (sacrifice layer) that is more likely to break but development of the crack C stops just before a first SiOCN film 104*g*1 that is less likely to break. As a result, no crack is formed in the first SiOCN film 104*g*1 in the lower layer and no entrance route of the ink is formed. Accordingly, it is possible to prevent dissolution of the electric wiring layer (AL wiring) 103.

From the viewpoint of sufficiently obtaining such an effect, a difference in C composition ratio (content ratio of carbon) between the first SiOCN film and the second SiOCN film is preferably 4 at. % or more, more preferably 5 at. % or more. The thickness of the second SiOCN film is preferably 80 nm or more, more preferably 100 nm or more.

The first SiOCN film and the second SiOCN film preferably have compositions within the following range from the viewpoint of manufacturability, electric insulation property, low stress, and resistance against ink erosion. Specifically, the first SiOCN film and the second SiOCN film are each preferably made of a material expressed by $Si_wO_xC_yN_z$ ($w+x+y+z=100$ (at, %), $37 \le w \le 60$ at. %), $30 \le x \le 53$ (at. %), $6 \le y \le 29$ (at. %), $4 \le z \le 9$ (at. %)).

The compositions of the films can be measured by transmission electron microscopy-energy dispersive X-ray spectroscopy (TEM-EDS), transmission electron microscopy-electron energy loss spectroscopy (TEM-EELS), or depth direction analysis of X-ray photoelectron spectroscopy (XPS).

Moreover, the second configuration for preventing dissolution of the electric wiring layer is a configuration in which the first insulating film is a SiOCN film and the second insulating film is a low-density insulating film with a lower density than the SiOCN film. Specifically, it is effective to provide a low-density insulating film (low-density interlayer film) that is difficult to dissolve into the ink and that has a lower density than a SiOCN film, on the SiOCN film as a measure against a crack. Such a configuration can prevent the ink from entering the deep portion by causing a crack to form preferentially in a brittle film with low density and preventing the crack from propagating to the SiOCN film.

From the viewpoint of substantially obtaining such an effect, a difference in density between the SiOCN film and the low-density insulating film (low-density interlayer film) is preferably 0.4 g/cm$^3$ or more, more preferably 0.5 g/cm$^3$ or more. A SiOC film (silicon oxycarbide film) is preferable as the low-density insulating film. The thickness of the low-density insulating film is preferably 80 nm or more, more preferably 100 nm or more.

The density of the film can be measured by X-ray reflectivity (XRR) or Rutherford backscattering spectrometry (RBS).

The thickness of the first SiOCN film is preferably 150 nm or more from the viewpoint of more sufficiently suppressing formation of a crack and preventing entrance of the ink even if a crack is formed in the second SiOCN film or the low-density insulating film. The thickness of the first SiOCN film is assumed to be the thickness of a portion formed on an upper surface of the electric wiring layer.

Figure 4:
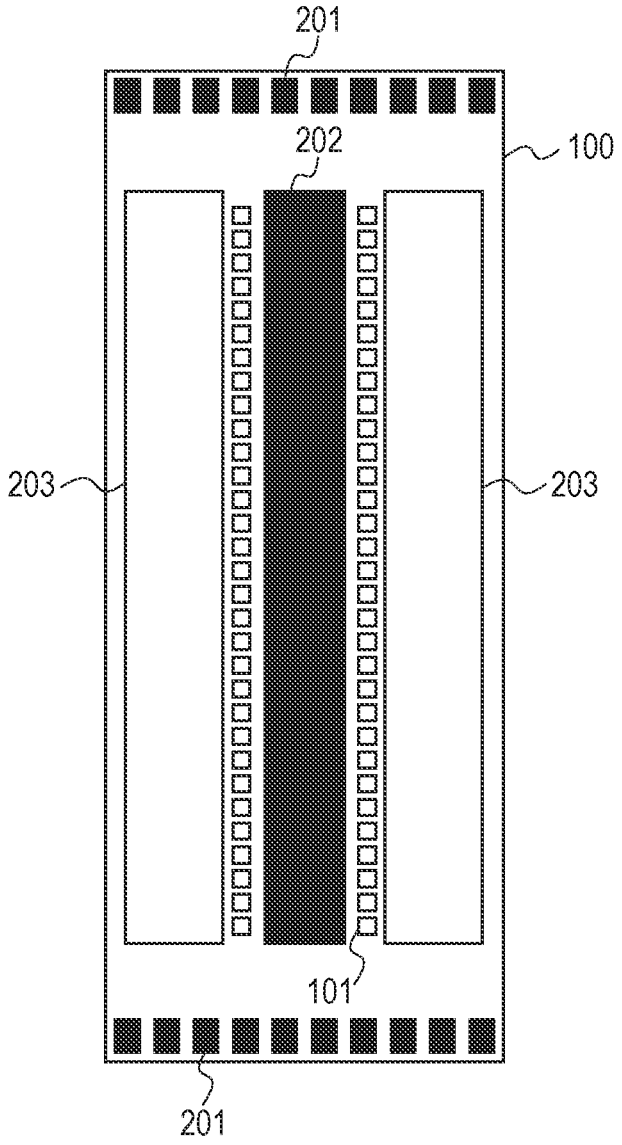
FIG. 4 is a plan view of a liquid ejection head circuit board.

As illustrated in FIG. 4, an ink supply port 202 extending in a longitudinal direction (matching the Y direction in FIGS. 1A and 1B in the embodiment) is provided in a center portion of the element circuit board 100 in the liquid ejection head circuit board and multiple heat generating resistance elements 101 are arranged in rows on both sides of the ink supply port 202. The heat generating resistance elements 101 are made of a Ta compound such as TaSiN. The film thickness (dimension in the Z direction in FIGS. 1A and 1B) of the heat generating resistance elements 101 is about 0.01 to 0.05 μm and is far smaller than the film thickness of the electric wiring layer 103 illustrated in FIGS. 1A and 1B to be described later.

As illustrated in FIGS. 1A and 1B, the ejection port formation member 108 is provided on the surface side of the circuit board 114 on which the heat generating resistance elements 101 are formed. The ejection port formation member 108 has ejection ports 109 corresponding to the respective heat generating resistance elements 101 and forms a pressure chamber 123 for each of the ejection ports 109, together with the circuit board 114. The pressure chamber 123 communicates with the ink supply port 202 (FIG. 4) and the ink supplied from the ink supply port 202 is introduced into the pressure chamber 123.

As illustrated in FIG. 4, drive circuits 203 for driving the heat generating resistance elements 101 are provided on both sides of the ink supply port 202 of the element circuit board 100. The drive circuits 203 are connected to electrode pads 201 provided at both ends of the element circuit board 100 in the longitudinal direction Y. Drive currents of the heat generating resistance elements 101 are generated depending on recording signals supplied from the outside of the liquid ejection head via the electrode pads 201.

As illustrated in FIGS. 1A and 1B, the electric wiring layer 103 for supplying the current to each heat generating resistance element 101 is provided in the interlayer insulating film 104 provided on the substrate 113. The electric wiring layer 103 is provided to be embedded in the interlayer insulating film 104. The electric wiring layer 103 electrically connects the drive circuit 203 and the heat generating resistance element 101 to each other via connection members 102 to be described later. The electric wiring layer 103 is made of aluminum and has a film thickness (Z direction dimension) of about 0.6 to 1.2 μm.

The heat generating resistance element 101 generates heat by using the current supplied via the electric wiring layer 103 and the heat generating resistance element 101 at high temperature heats the ink in the pressure chamber 123 to generate an air bubble. This air bubble causes the ink near the ejection port 109 to be ejected from the ejection port 109 and the recording is thus performed. Reading a temperature change in this case with the temperature detection element 115 enables determination of whether ejection is performed normally or not.

As illustrated in FIG. 1B, the heat generating resistance element 101 is covered with the protection film 105. The protection film 105 is made of SiN and has a film thickness of about 0.15 to 0.3 μm. The protection film 105 may be made of SiO or SiC. The protection film 105 is covered with the anti-cavitation film 106. The anti-cavitation film 106 is made of Ta and has a film thickness of about 0.2 to 0.3 μm.

As illustrated in FIG. 1B, the multiple connection members 102 for connecting the electric wiring layer 103 and the heat generating resistance element 101 to each other are provided in the interlayer insulating film 104. The connection members 102 extend in the film thickness direction (Z direction) and penetrate the interlayer insulating film to connect the heat generating resistance element 101 above the interlayer insulating film and the electric wiring layer 103 below the interlayer insulating film to each other. As illustrated in FIG. 1A, the multiple connection members 102 are located at intervals in the second direction Y perpendicular to the first direction X. The connection members 102 connected to the heat generating resistance element 101 are covered with the heat generating resistance element 101 as viewed in a direction perpendicular to the surface on which the heat generating resistance element 101 is provided. The connection members 102 connect the electric wiring layer 103 and the heat generating resistance element 101 to each other in both end portions of the heat generating resistance element 101 in the X direction. Accordingly, the current flows through the heat generating resistance element 101 in the X direction.

The multiple connection members 102 are provided near both end portions of the heat generating resistance element 101 in the X direction. The heat generating resistance element 101 has connection regions 110 to which the multiple connection members 102 are connected, in one end portion and the other end portion, respectively.

The connection members 102 are plugs extending in the Z direction from the electric wiring layer 103. Although the connection members 102 have a substantially square cross section in the embodiment, the connection members 102 may have rounded corner portions or other shapes such as rectangular, circular, or elliptical shapes and is not limited to the square shape. Although the connection members 102 are made of tungsten, the connection members 102 may be made of any of titanium, platinum, cobalt, nickel, molybdenum, tantalum, and silicon or a compound of these elements. The connection members 102 may be formed integrally with the electric wiring layer 103. Specifically, the connection members 102 integral with the electric wiring layer 103 may be formed by partially cutting away the electric wiring layer 103 in the thickness direction.

The connection regions 110 are the smallest rectangular regions that include all connection members 102 and whose four sides are circumscribed to any of the connection members 102. Although the connection regions 110 extend in the second direction Y orthogonal to the first direction X in FIG. 1A, the second direction Y may not be orthogonal to the first direction X. Specifically, the connection regions 110 may extend in a second direction obliquely intersecting the first direction X.

A region of the heat generating resistance element 101 that actually contributes to bubbling of the ink, that is a region in which bubbling of the ink occurs is referred to as bubbling region 111. The bubbling region 111 is inside an outer periphery of the heat generating resistance element 101 and a region between the bubbling region 111 and the outer periphery of the heat generating resistance element 101 is a region 112 that does not contribute to the bubbling of the ink (hereinafter, referred to as "frame region"). Although heat is generated also in the frame region 112 by supplying of a current, heat dissipation to the surrounding is large and no bubbling of the ink occurs. The dimensions of the bubbling region 111 in the X direction and the Y direction are determined by a structure around the heat generating resistance element 101, the thermal conductivity of the heat generating resistance element 101, and the like.

Each connection region 110 is adjacent to the bubbling region 111 in the first direction X with the frame region 112 arranged between the connection region 110 and the bubbling region 111 and extends over a range including the entire length of the bubbling region 111 in the second direction Y. Specifically, end portions 110*a* and 110*b* on both sides of the connection region 110 in the Y direction are closer to peripheral edge portions 101*a* and 101*b* on both sides of the heat generating resistance element 101 in the Y direction than peripheral edge portions 111*a* and 111*b* on both sides of the bubbling region 111 in the Y direction are, as viewed in the first direction X. This configuration makes the current density even in the entire bubbling region 111.

Underlying portions of the electric wiring layer 103 and the respective layers of the heat generating resistance element 101 are planarized by planarization processing such as chemical mechanical polishing (CMP) or the like. As illustrated in FIGS. 1A and 1B, a contact surface of the connection members 102 to the heat generating resistance element 101 and a contact surface of the interlayer insulating film 104 to the heat generating resistance element 101 are thus provided on the same plane.

In the embodiment, as illustrated in FIGS. 1A and 1B, the drive circuit 203 and a field oxide film 132 are formed on the substrate 113 made of Si, in an interfacial region between the substrate 113 and the interlayer insulating film 104.

In the embodiment illustrated in FIGS. 1A and 1B, the electric wiring layer 103 has a configuration including four layers varying in the distance to the heat generating resistance element 101.

The electric wiring layers 103*a* and 103*b* on the lower layer side are assigned as a signal wiring layer for driving the heat generating resistance element 101 and a logic power supply wiring layer. In the embodiment, the electric wiring layer 103*a* is the signal wiring layer (fourth electric wiring layer 103*a*) and the electric wiring layer 103*b* is the logic power supply wiring layer (third electric wiring layer 103*b*).

Meanwhile, the electric wiring layers 103*c* and 103*d* on the upper layer side (heat generating resistance element 101 side) are assigned as electric wiring layers for supplying the current to the heat generating resistance element 101. In the embodiment, the electric wiring layer 103*d* is a ground (GNDH) wiring layer (first electric wiring layer 103*d*), the electric wiring layers 103*c* is a power supply (VH) wiring layer (second electric wiring layer 103*c*), and the electric wiring layers 103*c* and 103*d* are both so-called solid-pattern wiring.

In the embodiment, four electric wiring layers of the electric wiring layers 103*c* and 103*d* that cause the current to flow in the heat generating resistance element 101 and the electric wiring layers 103*a* and 103*b* that serve as the signal wiring layer for driving the heat generating resistance element and the logic power supply wiring layer are included in the interlayer insulating film 104. The electric wiring layers 103*c* and 103*d* are preferably arranged closer to the heat generating resistance element 101 than the electric wiring layers 103*a* and 103*b* are, and have larger film thicknesses than the electric wiring layers 103*a* and 103*b*, in view of the efficiency. Meanwhile, the electric wiring layers 103*a* and 103*b* are preferably arranged closer to the drive circuit 203 than the electric wiring layers 103*c* and 103*d* are, and have smaller film thicknesses than the electric wiring layers 103*c* and 103*d*.

As illustrated in FIG. 1B, the heat generating resistance element 101 is divided into two electrode regions 121 each including the connection region 110 illustrated in FIG. 1A and a center region 122 located between the two electrode regions 121, in the first direction X. The two electrode regions 121 and the center region 122 have the same dimension in the second direction Y. Specifically, as illustrated in FIG. 1A, the heat generating resistance element 101 has a rectangular planar shape on an X-Y plane. In the embodiment, the width a and the intervals b of the connection members 102 and the overlap width c of the heat generating resistance element 101 are optimized based on the aforementioned shape of the heat generating resistance element 101. In this case, the width a of the connection members 102 is the width of each connection member 102 in the Y direction, the intervals b of the connection members 102 are intervals between the adjacent connection members 102 in the Y direction, and the overlap width c is the distance between each of the connection members 102 at both ends and a corresponding one of the peripheral edge portions 101*a* and 101*b* of the heat generating resistance element 101.

The aforementioned SiOCN film can be formed by using a plasma CVD method.

Figure 5:
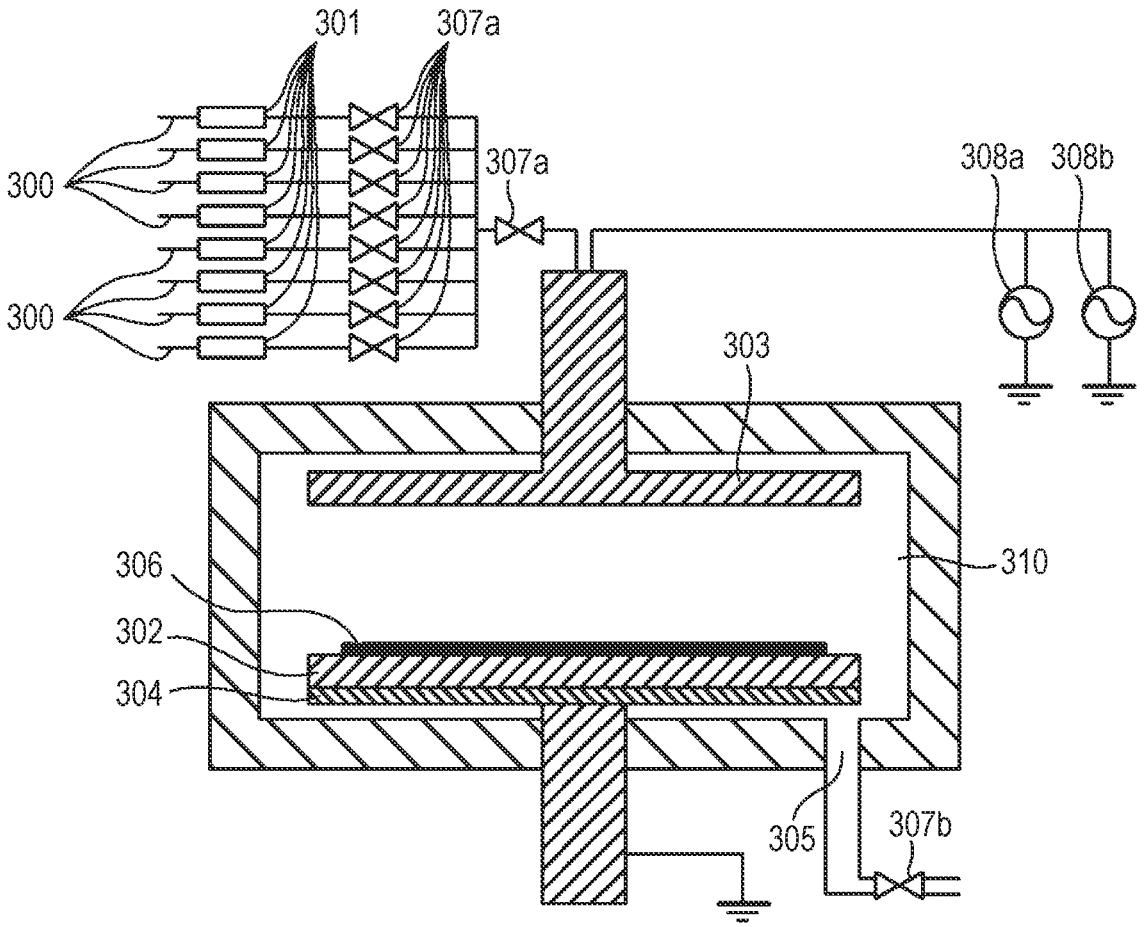
FIG. 5 is a schematic cross-sectional view for explaining a film formation apparatus of a SiOCN film.

FIG. 5 is a cross-sectional diagram schematically illustrating a film formation chamber of a plasma CVD apparatus used for the formation of the SiOCN film. An outline of a method of forming the SiOCN film is described below by using FIG. 5.

First, a distance (GAP) between a showerhead 303 that functions as an upper electrode in plasma discharging and a sample stage 302 that functions as a lower electrode is determined by adjusting the height of the sample stage 302. Moreover, the temperature of the sample stage 302 is adjusted by heating the sample stage 302 with a heater 304.

Next, various types of gases to be used are made to flow into a film formation chamber 310 through the showerhead 303. In this case, mass flow controllers 301 attached to pipes 300 for the respective gases control the flow rates of the respective gases. Thereafter, introduction valves 307*a* of the gases to be used are opened to mix the gases in the pipes and the mixed gases are supplied to the showerhead 303. Next, an exhaust valve 307*b* attached to an exhaust port 305 connected to a vacuum pump (not illustrated) is adjusted to control an exhaust amount and the pressure in the film formation chamber 310 is thereby maintained constant.

Then. RF power supplies 308*a* and 308*b* of two frequencies discharge plasma between the showerhead 303 and the sample stage 302. Atoms dissociated in the plasma are deposited on a wafer 306 and a film is thereby formed.

Film formation conditions of the SiOCN film in the embodiment of the present disclosure are preferably selected from the following ranges as appropriate.

$SiH_4$ gas flow rate: 20 to 300 sccm
$N_2O$ gas flow rate: 0.1 to 3 slpm
$CH_4$ gas flow rate: 0.1 to 5 slm
HRF power: 100 to 900 W
LRF power: 8 to 500 W
Pressure: 100 to 700 Pa
Temperature: 300 to 450° C.

SiOCN films varying in composition ratio can be obtained by adjusting these conditions and changing the flow rate ratio of the process gases of $SiH_4$, $N_2O$, and $CH_4$. Note that, in this description, the content ratio of each element in the SiOCN film is described in atomic percent (at. %).

Moreover, although the SiOCN film formed in the embodiment of the present disclosure contains hydrogen derived from the aforementioned raw-material gases of the CVD method, the content amount of hydrogen is not taken into consideration. A film formed by using the aforementioned raw-material gases generally contains about 15 to 30 at. % of hydrogen. The SiOCN film may contain hydrogen as long as the content amount of hydrogen does not greatly deviate from the aforementioned range, and the content amount is preferably equal to or less than 30 at. %.

EXAMPLES

The present disclosure is further described below by using examples and comparative examples. Note that the present disclosure is not limited to these examples.

Example 1

This example explains the case where resistance against a crack is improved by forming a SiOCN film with a configuration including two layers varying in C composition ratio.

In this example, the interlayer insulating film 104*e* (insulating film on the ground wiring layer 103*d*) was a laminated film as described below.

First, a plasma SiO film was formed on the ground wiring layer 103*d* and was planarized and a first SiOCN film was formed on the planarized surface of the plasma SiO film. Then, a second SiOCN film was formed and another plasma SiO film was formed and planarized to obtain the laminated film.

In this case, materials with three types of compositions with greater C composition ratios than the first SiOCN film (differences in C composition ratio to the first SiOCN film were 2 at. %, 5 at. %, and 7 at. %, respectively) were selected for the second SiOCN film. Moreover, the film thickness of the first SiOCN film was fixed to 150 nm and the film thickness of the second SiOCN film was varied in a range of 50 to 200 nm. Note that the measurement of the film composition was performed by the depth direction analysis of X-ray photoelectron spectroscopy (XPS).

The interlayer insulating films other than the interlayer insulating film 104*e* were formed by using plasma SiO films and a liquid ejection head circuit board having the configuration described by using FIGS. 1A, 1B, and FIG. 4 was fabricated.

A liquid ejection head was fabricated by using the liquid ejection head circuit board fabricated in the processes described above and was driven. Then, a cross-section of a damaged portion was observed. In the driving of the liquid ejection head, a pigment ink with pH of about 9 was used and drive conditions were such that the liquid ejection head was maintained at 60° C. and performed ejection for 72 hours.

The results are illustrated in Table 1. In the table, the case where there was no crack in the first SiOCN film is denoted by A, the case where some cracks were present in the first SiOCN film but did not lead to dissolution of the SiO film below the first SiOCN film is denoted by B, and the case where cracks were formed in the first SiOCN film and the SiO film below the SiOCN film dissolved is denoted by C.

As illustrated in Table 1, when the C composition ratio of the second SiOCN film was greater than that in the first SiOCN film by 5 at. % or more and the film thickness of the second SiOCN film was 100 nm or more, there was no crack in the first SiOCN film. It can be found that, in this case, no crack formed in the second SiOCN film propagates to the first SiOCN film and no ink penetrates the first SiOCN film. Moreover, it can be found that providing the second SiOCN film on the first SiOCN film can suppress formation of cracks.

Note that the cases where the film thickness of the first SiOCN film was varied were also carried out. When the film thickness of the first SiOCN film was 150 nm or more, wire breaking did not spread over a wide area even after occurrence of an incidental damage in the liquid ejection print head.

TABLE 1

| Difference in C composition ratio | Film thickness of second SiOCN film | | | |
|---|---|---|---|---|
| | 50 nm | 100 nm | 150 nm | 200 nm |
| 2 at. % | B | B | B | B |
| 5 at. % | B | A | A | A |
| 7 at. % | B | A | A | A |

Example 2

This example explains the case where resistance against a crack is improved by forming a SiOCN film with a configuration including two layers varying in C composition ratio in a layer configuration different from that of Example 1.

In this example, the interlayer insulating film 104*e* (insulating film on the ground wiring layer 103*d*) was a laminated film as described below.

First, a plasma SiO film was formed on the ground wiring layer 103*d* and a first SiOCN film was formed on the plasma SiO film without planarization of the plasma SiO film. Then, a second SiOCN film was formed and another plasma SiO film was formed and planarized to obtain the laminated film.

In this case, materials with three types of compositions with greater C composition ratios than the first SiOCN film (differences in C composition ratio to the first SiOCN film were 2 at %. 5 at. %, and 7 at. %, respectively) were selected for the second SiOCN film. Moreover, the film thickness of the first SiOCN film was fixed to 150 nm and the film thickness of the second SiOCN film was varied in a range of 50 to 200 nm. Note that the measurement of the film composition was performed by the depth direction analysis of X-ray photoelectron spectroscopy (XPS).

The interlayer insulating films other than the interlayer insulating film 104*e* were formed by using plasma SiO films and a liquid ejection head circuit board having the configuration described by using FIGS. 1A, 1B, and FIG. 4 was fabricated.

A liquid ejection head was fabricated by using the liquid ejection head circuit board fabricated in the processes described above and was driven. Then, a cross-section of a damaged portion was observed. In the driving of the liquid ejection head, a pigment ink with pH of about 9 was used and drive conditions were such that the liquid ejection head was maintained at 60° C. and performed ejection for 72 hours as in Example 1.

The results are illustrated in Table 2. In the table, the case where there was no crack in the first SiOCN film is denoted by A, the case where some cracks were present in the first SiOCN film but did not lead to dissolution of the SiO film below the first SiOCN film is denoted by B, and the case where cracks were formed in the first SiOCN film and the SiO film below the SiOCN film dissolved is denoted by C.

As illustrated in Table 2, when the C composition ratio of the second SiOCN film was greater than that in the first SiOCN film by 5 at. % or more and the film thickness of the second SiOCN film was 100 nm or more, there was no crack in the first SiOCN film. It can be found that, in this case, no crack formed in the second SiOCN film propagates to the first SiOCN film and no ink penetrates the first SiOCN film. Moreover, it can be found that providing the second SiOCN film on the first SiOCN film can suppress formation of cracks.

Note that the cases where the film thickness of the first SiOCN film was varied were also carried out. When the film thickness of the first SiOCN film was 150 nm or more, wire breaking did not spread over a wide area even after occurrence of an incidental damage in the liquid ejection print head.

TABLE 2

| Difference in C composition ratio | Film thickness of second SiOCN film | | | |
|---|---|---|---|---|
| | 50 nm | 100 nm | 150 nm | 200 nm |
| 2 at. % | B | B | B | B |
| 5 at. % | B | A | A | A |
| 7 at. % | B | A | A | A |

Example 3

This example explains the case where resistance against a crack is improved by providing a low-density insulating film (low-density interlayer film) with low density on the SiOCN film.

In this example, the interlayer insulating film 104*e* (insulating film on the ground wiring layer 103*d*) was a laminated film as described below.

First, a plasma SiO film was formed on the ground wiring layer 103*d* and was planarized and a SiOCN film was formed on the planarized surface of the plasma SiO film. Next, a SiOC film with a lower density than the SiOCN film was formed on the SiOCN film. Then, another plasma SiO film was formed on the SiOC film and planarized to obtain the laminated film.

In this case, the SiOC film was formed in the plasma CVD method using octamethylcyclotetrasiloxane (OMCTS) and oxygen ($O_2$) as raw materials. Three types of SiOC films varying in density were individually formed by adjusting film formation conditions. The density difference between the SiOC film and the SiOCN film was set to 0.3 g/cm$^3$, 0.5 g/cm$^3$, and 0.7 g/cm$^3$. Moreover, the film thickness of the SiOCN film was fixed to 150 nm and the film thickness of the SiOC film was varied in a range of 50 to 200 nm. Note that the densities of the films were measured by X-ray reflectivity (XRR).

The interlayer insulating films other than the interlayer insulating film 104*e* were formed by using plasma SiO films and a liquid ejection head circuit board having the configuration described by using FIGS. 1A, 1B, and FIG. 4 was fabricated.

A liquid ejection head was fabricated by using the liquid ejection head circuit board fabricated in the processes described above and was driven. Then, a cross-section of a damaged portion was observed. In the driving of the liquid ejection head, a pigment ink with pH of about 9 was used and drive conditions were such that the liquid ejection head was maintained at 60° C. and performed ejection for 72 hours as in Example 1.

The results are illustrated in Table 3. In the table, the case where no crack in the SiOCN film was present is denoted by A, the case where some cracks were present in the SiOCN film but did not lead to dissolution of the SiO film below the SiOCN film is denoted by B. and the case where cracks were formed in the SiOCN film and the SiO film below the SiOCN film dissolved is denoted by C.

From the results illustrated in Table 3, it can be found that, when the difference in density between the SiOCN film and the SiOC film is 0.5 g/cm$^3$ or more and the film thickness of the SiOC film is 100 nm or more, no crack formed in the SiOC film propagates to the SiOCN film and no ink penetrates the SiOCN film. Moreover, it can be found that providing the low-density insulating film on the SiOCN film can suppress formation of cracks.

Note that the cases where the film thickness of the SiOCN film was varied were also carried out. When the film thickness of the SiOCN film was 150 nm or more, wire breaking did not spread over a wide area even after occurrence of an incidental damage in the liquid ejection print head.

TABLE 3

| Difference in density | Film thickness of SiOC film | | | |
|---|---|---|---|---|
| | 50 nm | 100 nm | 150 nm | 200 nm |
| 0.7 g/cm$^3$ | B | A | A | A |
| 0.5 g/cm$^3$ | B | A | A | A |
| 0.3 g/cm$^3$ | B | B | B | B |

Example 4

This example explains the case where resistance against a crack is improved by providing a low-density insulating film (low-density interlayer film) with low density on the SiOCN film in a layer configuration different from that in Example 3.

In this example, the interlayer insulating film 104*e* (insulating film on the ground wiring layer 103*d*) was a laminated film as described below.

First, a plasma SiO film was formed on the ground wiring layer 103*d* and a SiOCN film was formed on the plasma SiO film without planarization of the plasma SiO film. Next, a SiOC film with a lower density than the SiOCN film was formed on the SiOCN film. Then, another plasma SiO film was formed on the SiOC film and planarized to obtain the laminated film.

In this case, the SiOC film was formed in the plasma CVD method using octamethylcyclotetrasiloxane (OMCTS) and oxygen ($O_2$) as raw materials. Three types of SiOC films varying in density were individually formed by adjusting film formation conditions. The density difference between the SiOC film and the SiOCN film was set to 0.3 g/cm$^3$, 0.5 g/cm$^3$, and 0.7 g/cm$^3$. Moreover, the film thickness of the SiOCN film was fixed to 150 nm and the film thickness of the SiOC film was varied in a range of 50 to 200 nm. Note that the densities of the films were measured by X-ray reflectivity (XRR).

The interlayer insulating films other than the interlayer insulating film 104*e* were formed by using plasma SiO films and a liquid ejection head circuit board having the configuration described by using FIGS. 1A, 1B, and FIG. 4 was fabricated.

A liquid ejection head was fabricated by using the liquid ejection head circuit board fabricated in the processes described above and was driven. Then, a cross-section of a damaged portion was observed. In the driving of the liquid ejection head, a pigment ink with pH of about 9 was used and drive conditions were such that the liquid ejection head was maintained at 60° C. and performed ejection for 72 hours as in Example 1.

The results are illustrated in Table 4. In the table, the case where there was no crack in the SiOCN film is denoted by A, the case where some cracks were present in the SiOCN film but did not lead to dissolution of the SiO film below the SiOCN film is denoted by B, and the case where cracks were formed in the SiOCN film and the SiO film below the SiOCN film dissolved is denoted by C.

From the results illustrated in Table 4, it can be found that, when the difference in density between the SiOCN film and the SiOC film is 0.5 g/cm$^3$ or more and the film thickness of the SiOC film is 100 nm or more, no crack formed in the SiOC film propagates to the SiOCN film and no ink penetrates the SiOCN film. Moreover, it can be found that providing the low-density insulating film on the SiOCN film can suppress formation of cracks.

Note that the cases where the film thickness of the SiOCN film was varied were also carried out. When the film thickness of the SiOCN film was 150 nm or more, wire breaking did not spread over a wide area even after occurrence of an incidental damage in the head.

TABLE 4

| | Film thickness of SiOC film | | | |
|---|---|---|---|---|
| Difference in density | 50 nm | 100 nm | 150 nm | 200 nm |
| 0.7 g/cm$^3$ | B | A | A | A |
| 0.5 g/cm$^3$ | B | A | A | A |
| 0.3 g/cm$^3$ | B | B | B | B |

Comparative Example 1

This comparative example explains test results obtained in the case where a single-layer SiOCN film was used instead of the first and second SiOCN films in the configuration of Example 1 (or the SiOCN film and the low-density insulating film in Example 3).

In the comparative example, the first SiOCN film in Example 1 (or the SiOCN film in Example 3) was formed as the single-layer SiOCN film. Then, a plasma SiO film was formed directly on the single-layer SiOCN film without formation of the second SiOCN film in Example 1 (or without formation of the low-density insulating film in Example 3) and was planarized to obtain the laminated film. A liquid ejection head circuit board was fabricated as in Example 1 (or Example 3) except for the formation of the laminated film described above.

A liquid ejection head was fabricated by using the liquid ejection head circuit board fabricated in the processes described above and was driven. Then, a cross-section of a damaged portion was observed. In the driving of the liquid ejection head, a pigment ink with pH of about 9 was used and drive conditions were such that the liquid ejection head was maintained at 60° C. and performed ejection for 72 hours as in Example 1.

As a result of driving the liquid ejection head, no SiOCN film dissolved. However, a crack was locally formed in the SiOCN film, the ink reached the deep portion, and the interlayer insulating film formed of the SiO film below the SiOCN film dissolved over a wide area.

Comparative Example 2

This comparative example explains test results obtained in the case where a single-layer SiOCN film was used instead of the first and second SiOCN films in the configuration of Example 2 (or the SiOCN film and the low-density insulating film in Example 4).

In the comparative example, the first SiOCN film in Example 2 (or the SiOCN film in Example 4) was formed as the single-layer SiOCN film. Then, a plasma SiO film was formed directly on the single-layer SiOCN film without formation of the second SiOCN film in Example 2 (or without formation of the low-density insulating film in Example 4) and was planarized to obtain the laminated film. A liquid ejection head circuit board was fabricated as in Example 2 (or Example 4) except for the formation of the laminated film described above.

A liquid ejection head was fabricated by using the liquid ejection head circuit board fabricated in the processes described above and was driven. Then, a cross-section of a damaged portion was observed. In the driving of the liquid ejection head, a pigment ink with pH of about 9 was used and drive conditions were such that the liquid ejection head was maintained at 60° C. and performed ejection for 72 hours as in Example 1.

As a result of driving the liquid ejection head, no SiOCN film dissolved. However, a crack was locally formed in the SiOCN film, the ink reached the deep portion, and the interlayer insulating film formed of the SiO film below the SiOCN film dissolved over a wide area.

While the present disclosure has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-189846, filed Nov. 13, 2020, which is hereby incorporated by reference herein in its entirety.

What is claimed is:

1. A liquid ejection head circuit board comprising:

a substrate;

a heat generating resistance element that generates heat energy used for ejection of liquid;

an electric wiring layer that is electrically connected to the heat generating resistance element; and an insulating film that insulates the electric wiring layer, wherein the insulating film includes a first insulating film and a second insulating film on the first insulating film, the first insulating film is a first SiOCN film, and the second insulating film is a second SiOCN film containing more carbon than the first SiOCN film or a low-density insulating film with a lower density than the first SiOCN film.

2. The liquid ejection head circuit board according to claim 1, wherein the insulating film including the first and second insulating films further includes first and second SiO films, and the first insulating film is formed on the first SiO film and the second SiO film is formed on the second insulating film.

3. The liquid ejection head circuit board according to claim 2, wherein the first SiO film is planarized.

4. The liquid ejection head circuit board according to claim 1, wherein the second insulating film is the second SiOCN film.

5. The liquid ejection head circuit board according to claim 4, wherein a difference in composition ratio of carbon between the first SiOCN film and the second SiOCN film is 5 at. % or more.

6. The liquid ejection head circuit board according to claim 1, wherein the second insulating film is the low-density insulating film.

7. The liquid ejection head circuit board according to claim 6, wherein a difference in density between the first SiOCN film and the low-density insulating film is 0.5 $g/cm^3$ or more.

8. The liquid ejection head circuit board according to claim 1, wherein the low-density insulating film is a SiOC film.

9. The liquid ejection head circuit board according to claim 1, wherein a thickness of the second insulating film is 100 nm or more.

10. The liquid ejection head circuit board according to claim 1, wherein a thickness of the first insulating film is 150 nm or more.

11. The liquid ejection head circuit board according to claim 1, further comprising a ground wiring layer and a power supply wiring layer as the electric wiring layer, wherein the insulating film including the first and second insulating films is at least one of an insulating film on the ground wiring layer and an insulating film on the power supply wiring layer.

12. A liquid ejection head including the liquid ejection head circuit board which comprises:

a substrate;

a heat generating resistance element that generates heat energy used for ejection of liquid;

an electric wiring layer that is electrically connected to the heat generating resistance element; and an insulating film that insulates the electric wiring layer, wherein the insulating film includes a first insulating film and a second insulating film on the first insulating film, the first insulating film is a first SiOCN film, and the second insulating film is a second SiOCN film containing more carbon than the first SiOCN film or a low-density insulating film with a lower density than the first SiOCN film.

* * * * *